US007859373B2

(12) United States Patent
Yamamoto et al.

(10) Patent No.: US 7,859,373 B2
(45) Date of Patent: Dec. 28, 2010

(54) CONTACT DEVICE

(75) Inventors: Ritsu Yamamoto, Kyotanabe (JP); Riichi Uotome, Katano (JP); Katsuya Uruma, Matsusaka (JP); Masahiro Ito, Ise (JP); Motoharu Kubo, Nakagawa (JP)

(73) Assignee: Panasonic Electric Works Co., Ltd., Kadoma-shi (JP)

( * ) Notice: Subject to any disclaimer, the term of this patent is extended or adjusted under 35 U.S.C. 154(b) by 0 days.

(21) Appl. No.: 11/628,154

(22) PCT Filed: Mar. 27, 2006

(86) PCT No.: PCT/JP2006/306104

§ 371 (c)(1),
(2), (4) Date: Nov. 30, 2006

(87) PCT Pub. No.: WO2006/104080

PCT Pub. Date: Oct. 5, 2006

(65) Prior Publication Data

US 2007/0241847 A1 Oct. 18, 2007

(30) Foreign Application Priority Data

Mar. 28, 2005 (JP) ..... 2005-093148
Mar. 28, 2005 (JP) ..... 2005-093149

(51) Int. Cl.
*H01H 67/02* (2006.01)

(52) U.S. Cl. ..... 335/126; 335/131

(58) Field of Classification Search ..... 335/126, 335/131

See application file for complete search history.

(56) References Cited

U.S. PATENT DOCUMENTS 3,076,075 A * 1/1963 Colvill ..... 335/126

(Continued)

FOREIGN PATENT DOCUMENTS

EP 1 353 348 A1 10/2003

(Continued)

OTHER PUBLICATIONS

Japanese Notification of Reasons for Refusal dated Nov. 17, 2009 issued in Japanese Patent Application No. 2005-255398.

*Primary Examiner*—Elvin G Enad
*Assistant Examiner*—Alexander Talpalatskiy
(74) *Attorney, Agent, or Firm*—Edwards Angell Palmer & Dodge LLP

(57) ABSTRACT

A contact device including a pair of fixed terminals 2 with a fixed contact 2*a* each, a movable armature 3 with movable contacts 3*a* which contact to or separate from the fixed contacts 2*a*, a movable shaft 4 connected to the movable armature 3 at its one end, a movable core 8 secured to the opposite end 4*b* side of the movable shaft 4, a movable core receiver 7 slid onto the movable shaft 4 so that it faces a surface 8*b* on the movable armature side of the movable core 3 to receive the movable core 8 driven by an electromagnetic mechanism, an impact absorber 17 disposed on a surface 7*a* on the movable armature side of the movable core receiver 7 to absorb an impact generated when the movable core 3 hit the movable core receiver 7, and a stopper 16 (a movement restriction member) disposed on a surface on the movable armature side of the impact absorber 17 to restrict a movement of the impact absorber 17.

23 Claims, 15 Drawing Sheets

U.S. PATENT DOCUMENTS

| | | | | | |
|---|---|---|---|---|---|
| 3,671,891 | A | * | 6/1972 | Usui et al. | 335/126 |
| 4,213,108 | A | * | 7/1980 | Gross | 335/131 |
| 4,755,781 | A | * | 7/1988 | Bogner | 335/131 |
| 5,142,924 | A | * | 9/1992 | Fasola et al. | 74/7 A |
| 5,394,128 | A | * | 2/1995 | Perreira et al. | 335/126 |
| 5,519,370 | A | * | 5/1996 | Perreira et al. | 335/154 |
| 5,677,656 | A | * | 10/1997 | Mauch et al. | 335/126 |
| 5,892,194 | A | * | 4/1999 | Uotome et al. | 218/68 |
| 5,909,067 | A | * | 6/1999 | Liadakis | 310/14 |
| 6,049,263 | A | * | 4/2000 | Vilou | 335/126 |
| 6,693,503 | B1 | * | 2/2004 | Nguyen et al. | 335/131 |
| 6,911,884 | B2 | * | 6/2005 | Uotome et al. | 335/132 |
| 2004/0027776 | A1 | * | 2/2004 | Uotome et al. | 361/160 |
| 2006/0050466 | A1 | | 3/2006 | Enomoto et al. | |

FOREIGN PATENT DOCUMENTS

| | | |
|---|---|---|
| JP | 56-117517 | 9/1981 |
| JP | 56-132712 | 10/1981 |
| JP | 58-3007 | 1/1983 |
| JP | 63-111742 | 7/1988 |
| JP | 63-250083 | 10/1988 |
| JP | 3002038 | 9/1994 |
| JP | 9-259728 | 10/1997 |
| JP | 11-232986 | 8/1999 |
| JP | 2002-42626 | 2/2002 |
| JP | 2002-57024 | 2/2002 |
| JP | 2003-197082 | 7/2003 |
| JP | 2004-355847 | 12/2004 |
| JP | 2005-26182 | 1/2005 |
| WO | WO 87/02824 | 5/1987 |

* cited by examiner

CONTACT DEVICE

BACKGROUND OF THE INVENTION

1. Field of the Invention

The present invention relates to a contact device suitable for a high-load relay and an electromagnetic relay.

2. Description of the Related Art

Japanese Non-examined Patent Publication No.11-232986 discloses a conventional contact device. The contact device comprises a fixed terminal with a fixed contact, a movable armature with a movable contact which contacts to or separates from the fixed contact, a movable shaft connected to the movable armature at its one end, a movable core secured to an opposite end of the movable shaft, a fixed core slid onto the movable shaft so as to face a surface on the movable armature side of the movable core, and an electromagnetic mechanism. When the electromagnetic mechanism is energized, the movable core is attracted to the fixed core, whereby the movable armature moves, and the movable contact comes into contact with the fixed contact. When the energization of the electromagnetic mechanism is stopped, the movable armature is moved in the reverse direction by a spring force, whereby the movable contact separates from the fixed contact.

By the way, in the contact device, when the movable core moved by energization of the electromagnetic mechanism hits the fixed core, a vibration (an impact) occurs, and the vibration is propagated through constructional elements of the electromagnetic mechanism, whereby an acoustic wave in the audible range (hereinafter, called an operating noise) may be radiated in the air. It is preferable to reduce such an operating noise as much as possible.

SUMMARY OF THE INVENTION

In view of the above problem, the object of the present invention is to provide a contact device which can suppress the vibration generated when the movable core moves and can reduce the operating noise.

The contact device of the present invention comprises a fixed terminal with a fixed contact, a movable armature with a movable contact which contacts to or separates from the fixed contact, a movable shaft connected to the movable armature at its one end, a movable core secured to an opposite end of the movable shaft, and an electromagnetic mechanism for driving the movable core in response to an excitation current so as to bring the movable contact into contact with the fixed contact. The feature of the present invention resides in that the contact device further comprises a movable core receiver slid onto the movable shaft so that it faces a surface on the movable armature side of the movable core to receive the movable core driven by the electromagnetic mechanism, an impact absorber disposed on a surface on the movable armature side of the movable core receiver to absorb an impact generated when the movable core hit the movable core receiver, and a movement restriction member disposed on a surface on the movable armature side of the impact absorber to restrict a movement of the impact absorber.

In this contact device of the present invention, because an impact (a vibration) generated when the movable core hit the movable core receiver is absorbed by the impact absorber, it is possible to reduce the operating noise generated when the movable core moves. Furthermore, because the impact absorber is disposed on not a surface on the movable core side of the movable core receiver but a surface on the movable armature side thereof, a magnetic gap is not generated between the movable core and the movable core receiver even when the impact absorber is provided, whereby an attraction force is not reduced.

In a preferable constitution of the contact device of the present invention, the electromagnetic mechanism includes a yoke which has a generally U-shaped configuration and houses the movable core and the movable core receiver therein, and the contact device further comprises a fixed plate made of a magnetic material and connected to the yoke so that it closes tips of the yoke, and the fixed plate has a hole into which the movable core receiver is inserted, and the movable core receiver has a flange at an end on the movable armature side and is engaged with a surface on the movable armature side of the fixed plate by the flange in a condition where an end on the movable core side of the movable core receiver is inserted into the hole of the fixed plate, and the movement restriction member has a cylindrical shape with a bottom and having a hole into which the movable shaft is inserted, and the movement restriction member is slid onto the movable shaft so that an inner bottom surface of the movement restriction member is in contact with the surface on the movable armature side of the impact absorber, and a periphery of an opening of the movement restriction member is fixed on the fixed plate.

Preferably, a surface of the movable core receiver and a surface of the movable core which face each other are inclined with respect to a moving direction of the movable core. In this case, as compared with a case where the surfaces of the movable core receiver and the movable core which face each other are orthogonal to the moving direction of the movable core, facing areas of the movable core and the movable core receiver are increased, and therefore the magnetic flux density is lowered when the movable core gets near the movable core receiver, and a magnetic attraction force becomes smaller. Thus, a moving speed of the movable core just before the movable core hits the movable core receiver is reduced, whereby the vibration generated when the movable core hit the movable core receiver is suppress.

Preferably, the impact absorber has a protrusion on a surface facing the movable core receiver and a tip of the protrusion is in contact with the movable core receiver. Or, it is also preferable that the impact absorber has a protrusion on a surface facing the movement restriction member and a tip of the protrusion is in contact with the movement restriction member. Or, it is also preferable that the movement restriction member has a protrusion on a surface facing the impact absorber and a tip of the protrusion is in contact with the impact absorber. Or, it is also preferable that the movable core receiver has a protrusion on a surface facing the impact absorber and a tip of the protrusion is in contact with the impact absorber. In these cases, even when a position of the impact absorber becomes misaligned, an impact absorbing effect of the impact absorber does not decrease, and the operating noise can be reduced with stability.

In the case of the contact device having the above mentioned constitution, it is preferable that the flange of the movable core receiver has a protrusion on a surface facing the fixed plate and a tip of the protrusion is in contact with the fixed plate. Or, it is also preferable that the fixed plate has a protrusion on a surface facing the flange of the movable core receiver and a tip of the protrusion is in contact with the flange of the movable core receiver. Or, it is also preferable that a residual plate made of a nonmagnetic material is disposed between the flange of the movable core receiver and the fixed plate. Or, it is also preferable that a residual ring made of a nonmagnetic material is disposed on an inner circumference surface of the hole of the fixed plate. Or, a residual plate made of a nonmagnetic material may be disposed between the flange of the movable core receiver and the fixed plate, and a residual ring made of a nonmagnetic material may be disposed on an inner circumference surface of the hole of the fixed plate, and the residual plate and the residual ring may be formed integrally. In these cases, the magnetic resistance between the flange of the movable core receiver and the fixed plate is increased and the magnetic attraction force is reduced, so that the impact absorbing effect of the impact absorber can be increased.

In another preferable constitution of the contact device of the present invention, the electromagnetic mechanism includes a yoke which has a generally U-shaped configuration and houses the movable core and the movable core receiver therein, and the contact device further comprises a fixed plate which is made of a magnetic material and is connected to the yoke so that it closes tips of the yoke and a fixed core, and the fixed core has a through hole into which the movable shaft is inserted and a flange at one end in the axial direction, and the fixed plate has a hole into which the fixed core is inserted, and the fixed core is secured to the fixed plate so that the flange is disposed between the fixed plate and the movable core, and the movable core receiver has a cylindrical shape with a bottom and has a hole in the bottom into which the fixed core is inserted, and the movement restriction member is slid onto the movable shaft so that an opening thereof faces the movable core side and is engaged with the flange of the fixed core by a periphery of the hole on the inner bottom side, and the impact absorber is disposed in a gap between an outer surface of the movable core receiver and the fixed plate, and a part of the fixed plate which is in contact with the impact absorber constitutes the movement restriction member.

In the above constitution, it is preferable that the fixed core has, on a surface on the movable core side, an inclined surface which inclines with respect to a moving direction of the movable core, and the movable core has, on a surface on the fixed core side thereof, an inclined surface which faces the inclined surface of the fixed core. In this case, the facing areas of the movable core and the fixed core are increased, whereby the magnetic flux density is lowered when the movable core gets near the movable core receiver, and the magnetic attraction force becomes smaller. Thus, the moving speed of the movable core just before the movable core hits the movable core receiver slows, whereby the vibration generated when the movable core hit the movable core receiver is suppress.

Furthermore, in the above constitution, it is preferable that the movable core receiver has a protrusion on the inner bottom surface, and a tip of the protrusion is in contact with the flange of the fixed core. Or, it is also preferable that the flange of the fixed core has a protrusion on a surface facing the inner bottom surface of the movable core receiver, and a tip of the protrusion is in contact with the inner bottom surface of the movable core receiver. Or, it is also preferable that a residual plate made of a nonmagnetic material is disposed between the flange of the fixed core receiver and the inner bottom surface of the movable core receiver. In these cases, the magnetic resistance between the inner bottom surface of the movable core receiver and the flange of the fixed core is increased and the magnetic attraction force is reduced, so that the impact absorbing effect of the impact absorber can be increased.

Preferably, the fixed contact has a conductive bar for electrical connection between the fixed terminal and an external electrical circuit, and the conductive bar is formed by stacking a plurality of thin plates in a thickness direction. In this case, stiffness of the conductive bar is lowered, so that the vibration is not easily propagated to the external electrical circuit, and it is possible to prevent the generation of the operating noise from the external electrical circuit connected to the fixed terminal through the conductive bar.

In the above case, preferably, both ends of the conductive bar are welded. In this case, the stiffness of the both ends of the conductive bar can be increased, so that it is possible to connect the fixed terminal and an external electrical circuit through the conductive bar with stability.

Preferably, the contact device further comprises a boxy case for surrounding the contact device, and the case has a holding piece on an inner surface thereof for holding the electromagnetic mechanism, and the electromagnetic mechanism is kept separated from the inner surface of the case except the holding piece. In this case, it is possible to suppress the propagation of the vibration from the contact device to the case.

In the above case, it is preferable that the electromagnetic mechanism has a generally U-shaped yoke, and the contact device further comprising a fixed plate made of a magnetic material and secured to the yoke so that it closes tips of the yoke, and the holding piece holds a curved part of the yoke and a junction part between the yoke and the fixed plate. The curved part of the yoke and the junction part between the yoke and the fixed plate each are a node of the vibration, and therefore they each have a small amplitude. So, by holding such a part by the holding piece, it is possible to effectively suppress the vibration propagated from the contact device to the case.

Or, it is also preferable that the electromagnetic mechanism further comprises a coil bobbin which has flanges at its both ends and around which a winding is wound between the flanges, and the holding piece holds the flanges of the coil bobbin. In this case, too, it is possible to effectively suppress the vibration propagated from the contact device to the case.

Preferably, the electromagnetic mechanism further comprises a coil bobbin which has flanges at its both ends and around which a winding is wound between the flanges, and a yoke which has a generally U-shaped configuration and houses the movable core and the movable core receiver therein and has, in an underside, a through hole which is communicated with an inside of the coil bobbin, and the yoke has an upstanding piece which rises from a periphery of the through hole toward the inside of the coil bobbin, and the movable core and the movable core receiver are housed in the coil bobbin in an order of the movable core to the movable core receiver from a side near the upstanding piece, and the movable core has a generally cylindrical shape, and a diameter of a part of the movable core which faces the upstanding piece is smaller than that of a part of the movable core which does not face the upstanding piece.

In this case, by disposing the upstanding piece around the part of the movable core having the small diameter, it is possible to eliminate a wasted space between the inner circumference surface of the cylindrical part of the coil bobbin and the movable core as well as the movable core receiver, and therefore it is possible to enlarge the space for winding a winding and to increase the magnetic efficiency. Furthermore, because the movable core is lightened by reducing the diameter of the movable core, the vibration generated when the movable core hit the movable core receiver is suppressed, whereby the operating noise can be reduced.

BRIEF DESCRIPTION OF THE DRAWINGS

FIG. 190 is a plan view showing another constitution of the substantial part of the contact device of FIG. 1.

DETAILED DESCRIPTION OF EXEMPLARY EMBODIMENTS

Hereinafter, the present invention will be described in more detail with reference to the accompanying drawings.

First Embodiment

Figure 1:
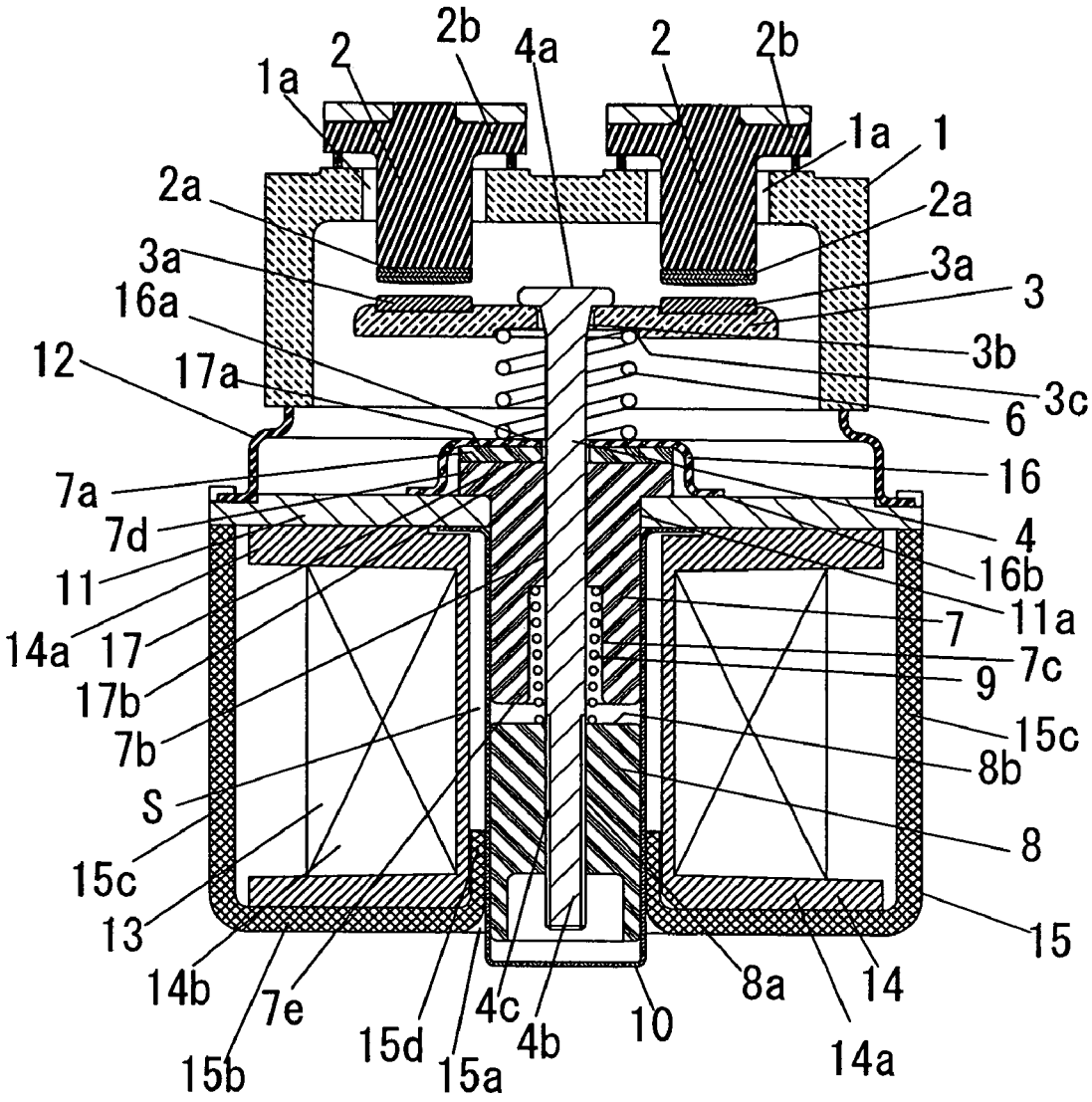
FIG. 1 is a sectional view of a contact device in accordance with a first embodiment of the present invention.
Figure 2:
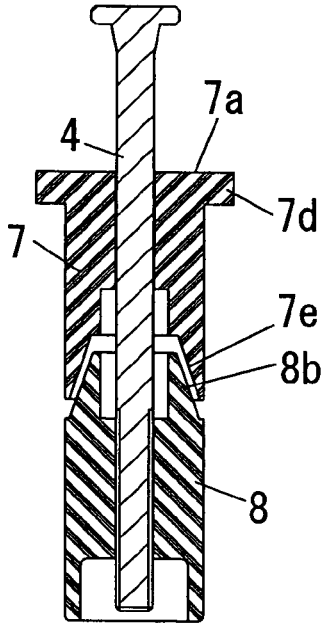
FIG. 2 is a sectional view showing another constitution of a substantial part of the contact device of FIG. 1.
Figure 3:
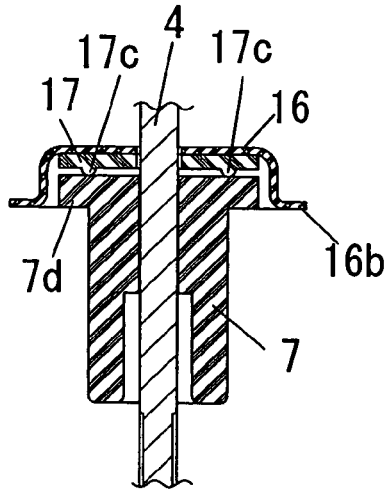
FIG. 3 is a sectional view showing another constitution of a substantial part of the contact device of FIG. 1.

FIG. 1 shows a contact device in accordance with a first embodiment of the present invention. The contact device is a so-called normally open sealed contact device that is open in the non-energized state, and comprises a sealed contact part and an electromagnetic mechanism.

First, the sealed contact part will be explained below. The sealed contact part comprises a sealed case 1 made of a heat resisting material such as ceramic, a pair of fixed terminals 2 having a fixed contact 2*a* each, a movable armature 3 with movable contacts 3*a* which contact to or separate from the fixed contacts 2*a*, a movable shaft 4 connected to the movable armature 3 at its one end 4*a*, a movable core 8 secured to an opposite end 4*b* of the movable shaft 4, a movable core receiver 7 which is slid onto the movable shaft 4 so that it faces a surface 8*b* on the movable armature side of the movable core 8 to receive the movable core 8 driven by the electromagnetic mechanism, a return spring 9 disposed between the movable core 8 and the movable core receiver 7, a fixed plate 11 for holding the movable core receiver 7, a cap 10 for housing the movable core 8 and the movable core receiver 7, an impact absorber 17 which is disposed on a surface 7*a* on the movable armature side of the movable core receiver 7 to absorb an impact generated when the movable core 8 hit the movable core receiver 7, a stopper (movement restriction member) 16 which is disposed on a surface 17*a* on the movable armature side of the impact absorber 17 to restrict a movement of the impact absorber 17, a pressure spring 6 disposed between the stopper 16 and the movable armature 3, and a connection member 12 for connecting the sealed case 1 and the fixed plate 11.

The sealed case 1 has a boxy shape whose one face is opened, and has two through holes la in the bottom.

Each fixed terminal 2 is formed into a cylindrical shape with a bottom from a copper material and so on, and the fixed contact 2*a* is secured to one end on the bottom side of the each fixed terminal 2, and a flange 2*b* is formed at the other end of each fixed terminal 2. The one end of each fixed terminal 2 is inserted into the sealed case 1 through the through hole 1 a, and the flange 2*b* is hermetically connected to outer bottom surface of the sealed case 1 by means of brazing and so on.

The movable armature 3 is formed into a flat plate shape from a cooper material and so on, and the pair of movable contacts 3*a*, which contacts to or separates from the pair of fixed contacts 2*a*, are secured to a surface of the movable armature 3 which faces the pair of fixed contacts 2*a*. The movable armature 3 has a though hole 3*b* at its center into which one end 4*a* of the movable shaft 4 is inserted.

The movable shaft 4 is formed into a generally round bar shape from an insulating material. One end 4*a* of the movable shaft 4 is inserted into the through hole 3*b* of the movable armature 3 and then caulked so as to restrict the movement of the movable armature 3 to the fixed contact 2*a* side. A male thread 4*c* is formed on the opposite end 4*b* of the movable shaft 4.

The movable core 8 is formed into a generally cylindrical shape, and has a through hole 8*a*. The through hole 8*a* has a female (not shown) which can be connected to the male thread 4*c* of the movable shaft 4, and the movable core 8 is connected to the opposite end 4*b* of the movable shaft 4. The connecting position between the movable core 8 and the movable shaft 4 is adjustable along the axial direction of the movable shaft.

The movable core receiver 7 is formed into a generally cylindrical shape from a magnetic material, and has a flange 7*d* at its one end, and has a concave portion 7*c* for housing the return spring 9 at the other end. The movable core receiver 7 further has a through hole 7*b* into which the movable shaft 4 is inserted, and is slid onto the movable shaft 4 so that it faces the surface 8*b* on the movable armature side of the movable core 8.

The return spring 9 is a helical compression spring, and is slid onto the movable shaft 4 between the movable core 8 and the movable core receiver 7. One end of the return spring is housed in the concave portion 7*c* of the movable core receiver 7 and is in contact with the bottom thereof, and the other end of the return spring is in contact with the surface 8*b* on the movable armature side of the movable core 8. The return spring 9 biases the movable core 8 in a direction in which the movable contact 3*a* moves away from the fixed contact 2*a*.

The fixed plate 11 is formed into a rectangular shape from a magnetic material such as iron, and has a hole 11 a at the center. The movable core receiver 7 is engaged with a surface on the movable armature side of the fixed plate by the flange 7*d* in a condition where the other end (a lower end in FIG. 1) on the movable core side of the movable core receiver is inserted into the hole 11 a of the fixed plate 11.

The cap 10 is made of a nonmagnetic material, and has a cylindrical shape with a bottom. The cap 10 houses the movable core 8 and the movable core receiver 7 therein, and the opening thereof is hermetically connected to a periphery of the hole 11 a on a surface on the movable core side of the fixed plate 11 (a lower surface in FIG. 1). The movable core 8 is separated from the movable core receiver in the cap 10, and is movable along the axial direction (in the vertical direction in FIG. 1).

The impact absorber 17 is formed into a disk shape from an elastic material such as silicon rubber, and has, at the center, a through hole 17*b* into which the movable shaft 4 is inserted. The impact absorber 17 is slid onto the movable shaft 4 through the through hole 17*b*, and is disposed on the surface 7*a* on the movable armature side of the movable core receiver 7.

The stopper (the movement restriction member) 16 is formed into a cylindrical shape with a bottom by processing a plate-like metal member, and has, at the center of the bottom, a through hole 16*a* into which the movable shaft 4 is inserted. The stopper 16 is slid onto the movable shaft 4 in a condition where an opening of it faces the impact absorber 17, and then the flange 16*b* of the stopper is secured to the surface on the movable armature side of the fixed plate 11 in a condition where the inner bottom of the stopper is in contact with the surface 17*a* on the movable armature side of the impact absorber 17. Consequently, the impact absorber 17 and the movable core receiver 7 are restricted from moving to the movable armature side by the stopper 16.

The pressure spring 6 is a helical compression spring, and is slid onto the movable shaft 4 between the stopper 16 and the movable armature 3. The pressure spring 6 biases the movable armature 3 to the fixed terminal 2 side.

The connection member 12 is formed into a cylindrical shape from a metal material. One opening thereof is hermetically connected to an opening of the sealed case 1, and the other opening is hermetically connected to the fixed plate 11. As a result, an airtight space for housing the fixed contacts 2*a*, the movable contacts 3*a*, the movable core 8, and the movable core receiver 7 is formed. Inside the airtight space, gas mainly comprising hydrogen is encapsulated so as to extinguish an arc which arose between the fixed contacts 2*a* and the movable contacts 3*a* in a small amount of time.

Next, the electromagnetic mechanism of the contact device of the present invention will be explained. This electromagnetic mechanism has a yoke 15 which has a generally U-shape and houses a coil 13 therein.

The coil 12 has a coil bobbin 14 which has a cylindrical shape and has flanges 14*a* at both ends. A winding 14*b* is wound around the coil bobbin 14 between the flanges 14*a*.

The yoke 15 comprises a center piece 15*b* and a pair of side pieces 15*c* upstanding from both ends of the center piece 15*b*. The yoke 15 has, at the center of the center piece 15*b*, a through hole 15*a* which is communicated with an inside of the coil bobbin 14, and has an upstanding piece 15*d* which rises from a periphery of the through hole 15*a* toward the inside of the coil bobbin 14.

The above mentioned fixed plate 11 is connected to the tips of the both side pieces 15*c* so that it closes the tips of the yoke 15, and the cap 10 in which the movable core 8 and the movable core receiver 7 were housed is put in the coil bobbin 14. The fixed plate 11 forms a magnetic circuit in conjunction with the yoke 15, the movable core 8, and the movable core receiver 7.

The contact device constituted as above works as bellow.

When the coil 13 is not energized, that is, when the coil 13 is in an initial state, the movable contacts 3*a* face the fixed contacts 2*a* at a predetermined distance (contact gap). The movable core 8 is also faces the movable core receiver 7 at a predetermined distance.

When the coil 13 is energized, the movable core 8 is attracted to the movable core receiver 7 and moves thereto. As a result, the movable shaft 4 connected to the movable core 8 moves to the fixed terminal 2 side, whereby the movable contacts 3*a* come in contact with the fixed contacts 2*a*. When the movable contacts 3*a* came in contact with the fixed contacts 2*a*, a spring load of the pressure spring 6 is lost, and a spring load of the movable core 8 becomes large suddenly by the lost spring force of the pressure spring 6. After that, the movable core 8 over-travels, and it comes in contact with the movable core receiver 7. The sum of the contact gap and the over-traveling amount equals to the stroke of the movable core 8.

When the energization of the coil 13 is stopped, the movable armature 3 moves in the reverse direction by, mainly, the spring force of the return spring 9. As a result, the movable contacts 3*a* separate from the fixed contacts 2*a*, and the movable core 8 also separates from the movable core receiver 7, and the contact device returns to the initial state. The arc which arose between contacts when returning is stretched to both ends of the movable armature 3 by magnetic field of a magnetic means (not shown), and is extinguished.

It should be noted that, in this embodiment, because the impact absorber 17 is disposed between the movable core receiver 7 and the stopper 16, the impact (vibration) generated when the movable core 8 hits the movable core receiver 7 is absorbed by the impact absorber 17. Therefore, the contact device of the present invention can suppress the propagation of the impact (vibration) generated when the movable core 8 hit the movable core receiver 7 to the fixed plate 11 and the yoke 15, so that it can reduce the operating noise generated when the movable core moves. Furthermore, in this embodiment, because the impact absorber 17 is disposed on not the surface on the movable core side of the movable core receiver 7 but the surface on the movable armature side thereof, a magnetic gap is not generated between the movable core 8 and the movable core receiver 7 even when the impact absorber 17 is provided, whereby the attraction force is not reduced.

Although the surfaces 8*b* of the movable core 8 and the surface 7*e* of the movable core receiver 7 which face each other are orthogonal to the moving direction of the movable core 8 (the vertical direction in FIG. 1) in this embodiment, the surfaces 8*b* and 7*e* of the movable core 8 and the movable core receiver 7 which face each other may be inclined with respect to the moving direction of the movable core 8.

When the surface 7*e* and the surface 8*b* are inclined with respect to the moving direction of the movable core 8, as compared with the case where both surfaces 7*e* and 8*b* are orthogonal to the moving direction of the movable core 8, the gap between the surface 7*e* and the surface 8*b* becomes small, so that the magnetic attraction force between the movable core 8 and the movable core receiver 7 is increased. On the other hand, because total magnetic flux of each case is the same, in the case where the surface 7*e* and the surface 8*b* are inclined, when the movable core 8 comes close to the movable core receiver 8*b* and the gap between the surfaces 7*e* and 8*b* becomes smaller, the magnetic flux density is lowered by the increased facing areas, whereby the magnetic attraction force becomes smaller. Thus, the moving speed of the movable core 8 just before the movable core 8 hits the movable core receiver 7 is reduced, whereby the vibration generated when the movable core 8 hit the movable core receiver 7 can be suppress.

By the way, in the contact device of this embodiment shown in FIG. 1, because the whole area of the impact absorber 17 is in contact with the movable core receiver 7, if a relative positional relation between the impact absorber 17 and the movable core receiver 7 becomes misaligned, the impact absorbing effect by the impact absorber 17 may be reduced. So, it is preferable that the impact absorber 17 has a plurality of protrusions 17*c* on the surface facing the movable core receiver 7 and the tips of the protrusions 17*c* are in contact with the movable core receiver 7. In these cases, even when the relative positional relation between the impact absorber 17 and the movable core receiver 7 becomes misaligned, the impact absorbing effect by the impact absorber 17 is not reduced, and the operating noise can be reduced with stability.

Figure 4:
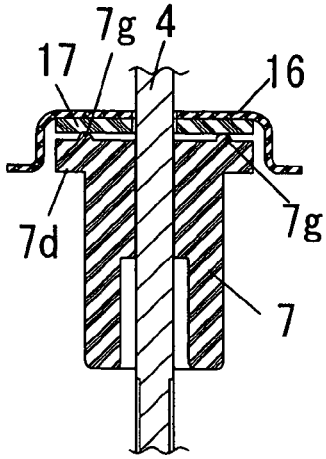
FIG. 4 is a sectional view showing another constitution of the substantial part of the contact device of FIG. 1.
Figure 5:
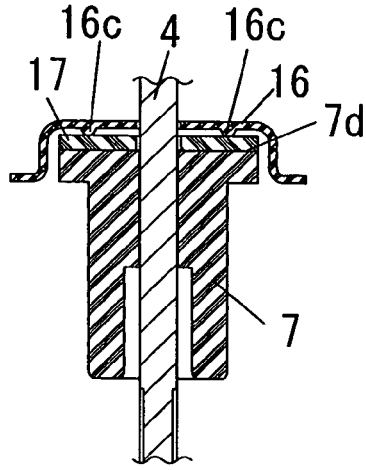
FIG. 5 is a sectional view showing another constitution of the substantial part of the contact device of FIG. 1.
Figure 6:
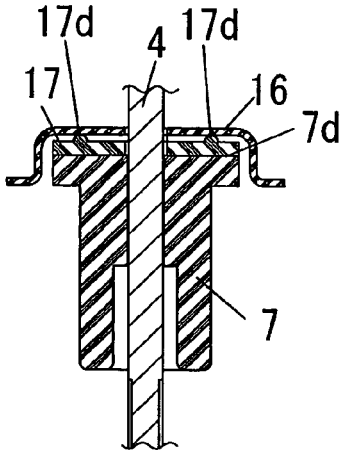
FIG. 6 is a sectional view showing another constitution of the substantial part of the contact device of FIG. 1.

In order to obtain the same effect, the movable core receiver 7 may have a plurality of protrusions 7*g* on the surface facing the impact absorber 17 and the tips of the protrusions 7*g* may be in contact with the impact absorber 17, as shown in FIG. 4. Or, as shown in FIG. 5, the stopper 16 may have a plurality of protrusions 16*c* on the surface facing the impact absorber 17 and the tips of the protrusions may be in contact with the impact absorber 17. Or, as shown in FIG. 6, the impact absorber 17 may have a plurality of protrusions on the surface facing the stopper 16 and the tips of the protrusions may be in contact with the stopper 16.

By the way, when the coil 13 is energized, a magnetic path is formed between the outer flange 7*d* of the movable core receiver 7 and the fixed plate 11. So, the magnetic attraction force may act on the movable core receiver 7 in a direction away from the impact absorber 17 (in the downward direction in FIG.1), and the impact absorbing effect by the impact absorber 17 may be reduced.

Figure 7:
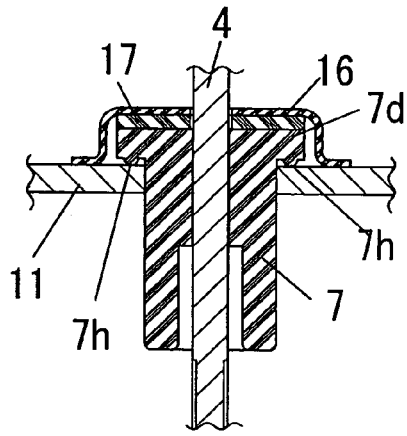
FIG. 7 is a sectional view showing another constitution of the substantial part of the contact device of FIG. 1.

So, preferably, as shown in FIG. 7, the flange 7*d* of the movable core receiver 7 has a plurality of protrusions 7*h* on the surface facing the fixed plate 11 and the tips of the protrusions 7*h* are in contact with the fixed plate 11. In this case, the magnetic resistance between the flange 7*d* and the fixed plate 11 is increased and the magnetic attraction force is reduced, so that the impact absorbing effect of the impact absorber 17 can be increased.

Figure 8:
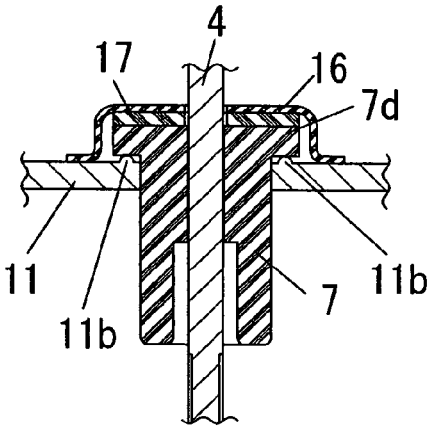
FIG. 8 is a sectional view showing another constitution of the substantial part of the contact device of FIG. 1.
Figure 9:
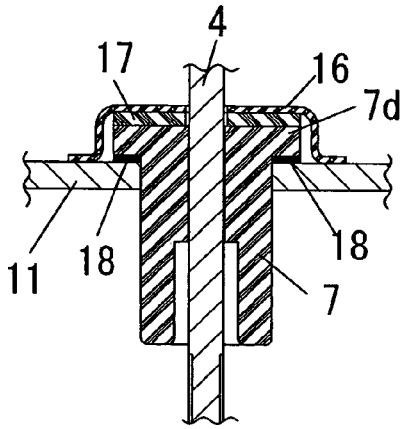
FIG. 9 is a sectional view showing another constitution of the substantial part of the contact device of FIG. 1.
Figure 10:
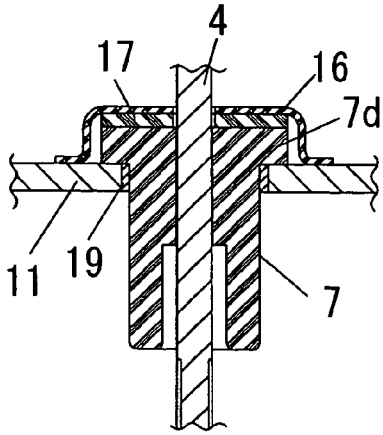
FIG. 10 is a sectional view showing another constitution of the substantial part of the contact device of FIG. 1.
Figure 11:
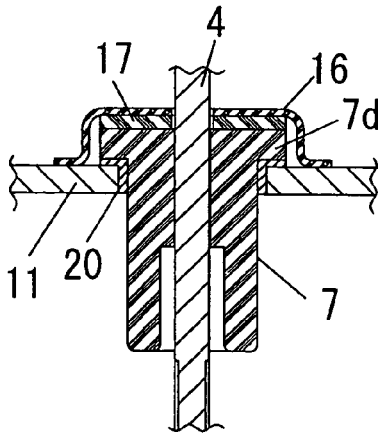
FIG. 11 is a sectional view showing another constitution of the substantial part of the contact device of FIG. 1.

In order to obtain the same effect, the fixed plate 11 may have a plurality of protrusions 11 on the surface facing the flange 7*d* of the movable core receiver 7, and the tips of the protrusions may be in contact with the flange 7*d*, as shown in FIG. 8. Or, as shown in FIG. 9, a residual plate 18 made of a nonmagnetic material may be disposed between the flange 7*d* of the movable core receiver 7 and the fixed plate 7*d*. Or, as shown in FIG. 10, a ring-shaped residual ring 19 made of a nonmagnetic material may be slid onto the movable core receiver 7, and the residual ring 19 may be disposed on the inner circumference surface of the hole 11 of the fixed plate 11. In this case, the magnetic resistance between the inner circumference surface of the hole 11 a and the movable core receiver 7 is increased and the magnetic attraction force acting between the fixed plate 11 and the movable core receiver 7 is reduced, so that the impact absorbing effect of the impact absorber 17 can be increased. Or, as shown in FIG. 11, a member 20 (a residual cap 20) formed by integrally forming the residual plate and the residual ring may be disposed between the fixed plate 11 and the movable core receiver 7.

Figure 12A:
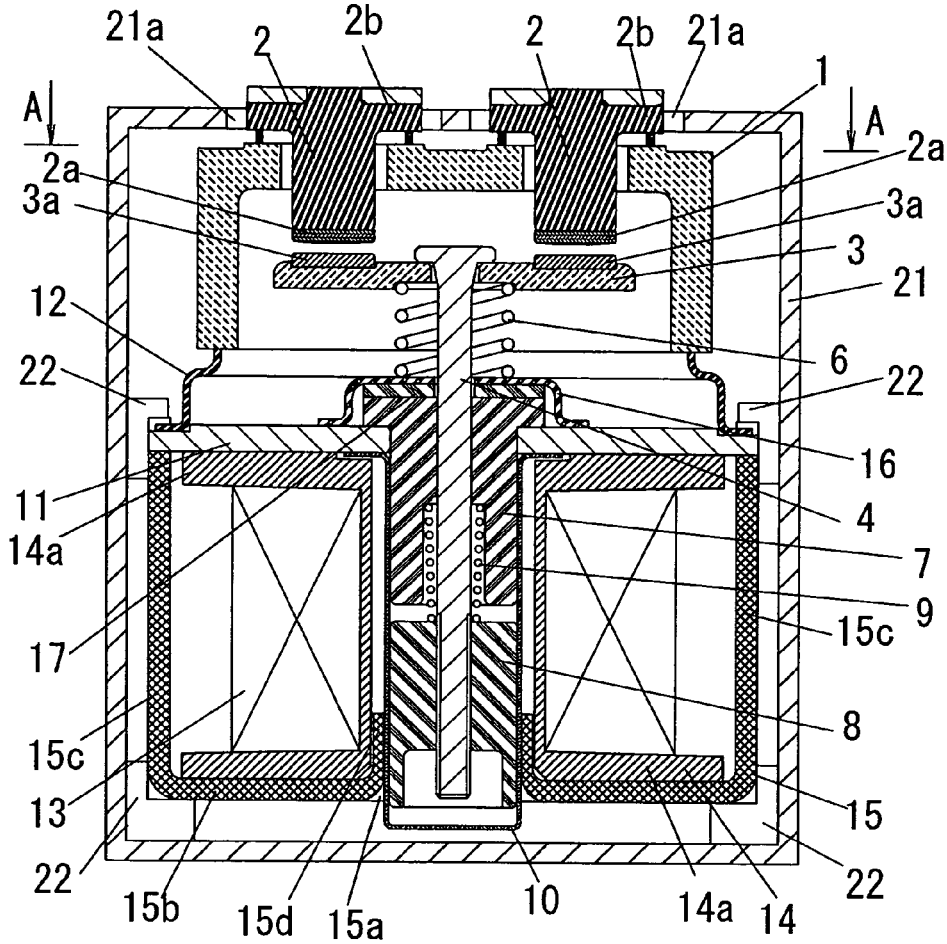
FIG. 12A is a sectional view showing the contact device of FIG. 1 housed in a case.
Figure 12B:
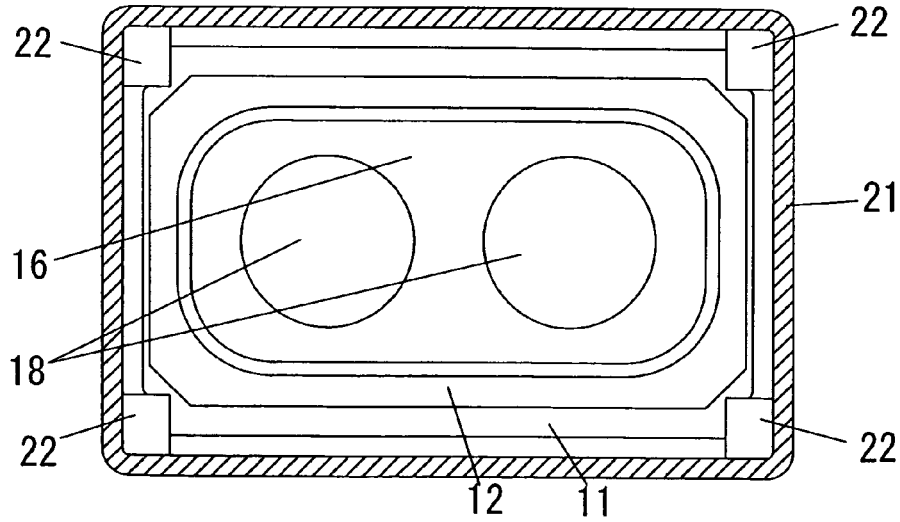
FIG. 12B is a sectional view of the contact device of FIG. 12A along the A-A line.

As shown in FIG. 12A, the contact device constituted as above is housed in the insulating case 21. The case 21 is boxy, and is assembled from two members which can be separated from each other in the vertical direction of FIG. 12B. The case 21 surrounds the contact device, and has a pair of terminal holes 21 a for exposing the flanges 2*b* of the fixed terminals 2 in the upper surface.

The case 21 has holding pieces 22 on an inner surface thereof. The holding pieces 22 are formed at eight places: at four corners of the bottom of the case 21 and at four corners near the fixed plate 11 of the contact device. Each of the holding pieces 22 at four corners of the bottom is L-shaped configuration, and holds a curved part of the yoke 15. That is, each holding piece 22 holds the center piece 15*b* of the yoke 15 from the underside of FIG. 12A, and holds the side pieces 15*c* from the outside. Each holding piece 22 near the fixed plate 11 has a generally inverted L shape, and holds a junction part between the yoke 15 and the fixed plate 11. That is, each holding piece 22 holds the fixed plate 11 from the upper side, and holds the side pieces 15*c* of the yoke 15 from the outside. The position of the contact device is restricted by the eight holding pieces inside the case 21 in the vertical direction and the horizontal direction of FIG. 12A. The contact device is housed in the case 21 before the case 21 is assembled.

When the contact device is housed in the case 21, the contact device is kept separated from the inner surface of the case except the holding pieces 22. Therefore, even when the vibration is generated in the contact device, the propagation of the vibration from the contact device to the case 21 can be suppressed. Furthermore, because the curved part of the yoke and the junction part between the yoke and the fixed plate each. are a node of the vibration, they each have a small amplitude. So, it is possible to effectively suppress the vibration propagated from the contact device to the case 21 by holding such a part by the holding piece 22. Furthermore, by restricting the movement of the contact device in the vertical direction of FIG. 12A by means of the holding pieces 22, a vibration itself which is generated when the movable core 8 hits the movable core receiver 7 can be suppressed. In addition, when the case 21 is configured to be separable, it is possible to maintain and replace the contact device in a condition where the case 21 is opened.

Figure 13A:
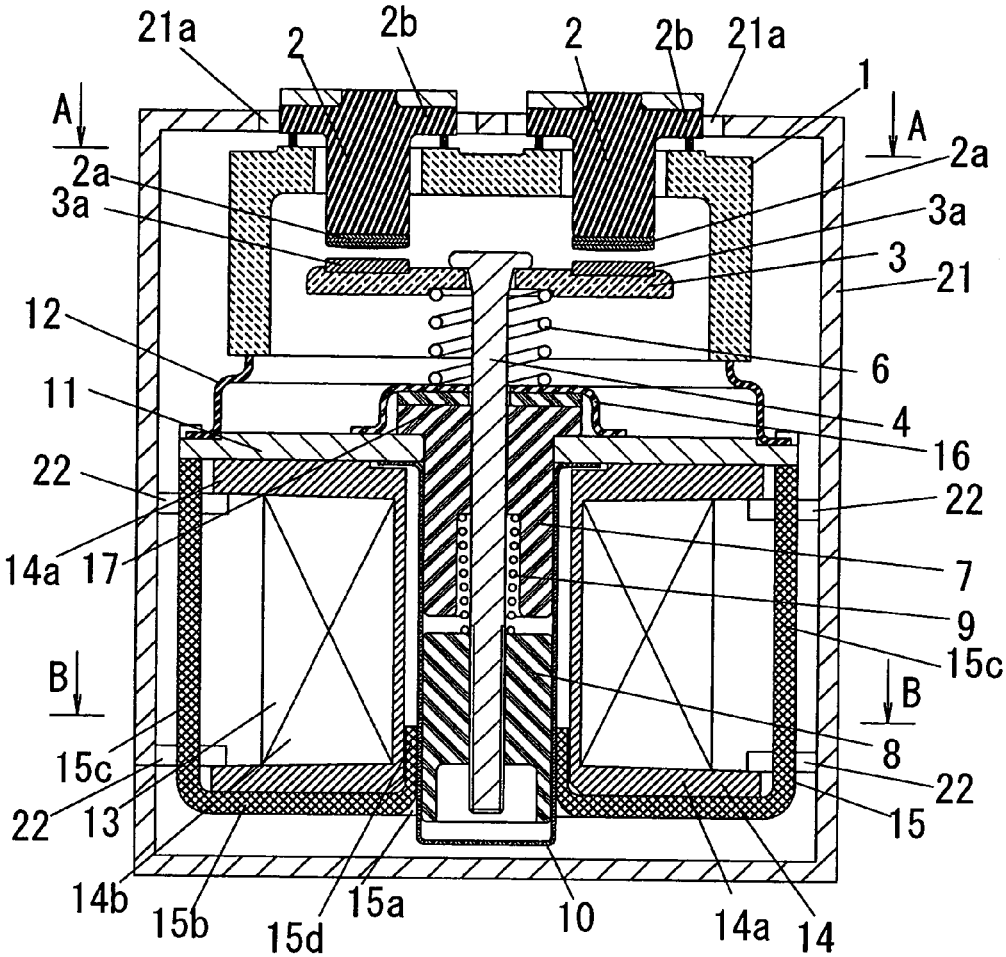
FIG. 13A is a sectional view of the contact device of FIG. 1 housed in another case.
Figure 13B:
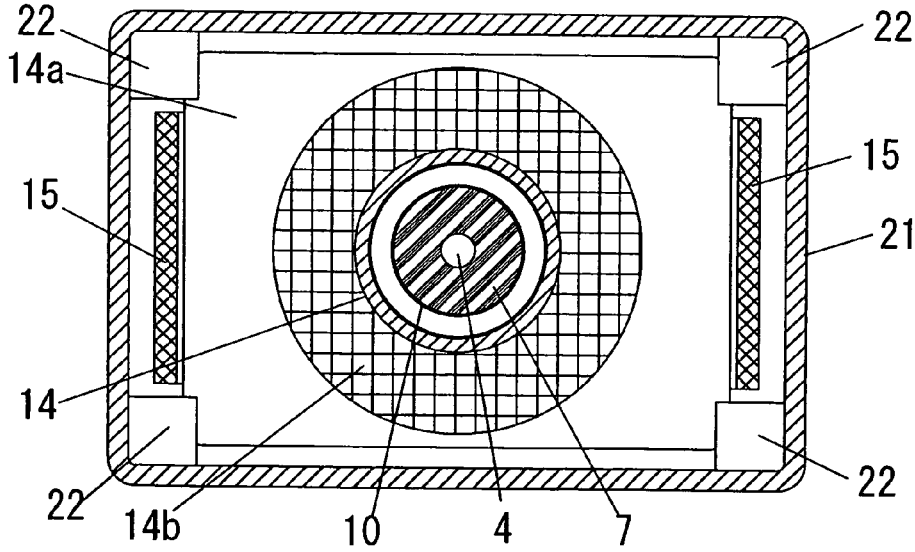
FIG. 13B is a sectional view of the contact device of FIG. 13A along the B-B line.

Instead of holding the curved part of the yoke 15 and the junction part between the yoke 15 and the fixed plate 11, it is also preferable that, as shown in FIGS. 13A and 13B, each holding pieces 22 holds the both flanges 14*a* of the coil bobbin 14. Each holding piece 22 of FIGS. 13A and 13B has a rectangular shape, and holds four corners of the upper surface of the lower flange 14*a* of the coil bobbin 14 of FIG. 13A and four corners of the undersurface of the upper flange 14*a* thereof. Because the coil bobbin 14 is not directly secured to the movable core 8 or the movable core receiver 7, even when the vibration is generated when the movable core 8 hits the movable core receiver 7, the vibration is not easily propagated to the coil bobbin. Furthermore, because the coil bobbin is made of resin, it is difficult for the coil bobbin to propagate the vibration. Therefore, by holding the coil bobbin 4 by the holding pieces 22, it is possible to effectively suppress the vibration propagated from the contact device to the case 21.

Figure 14:
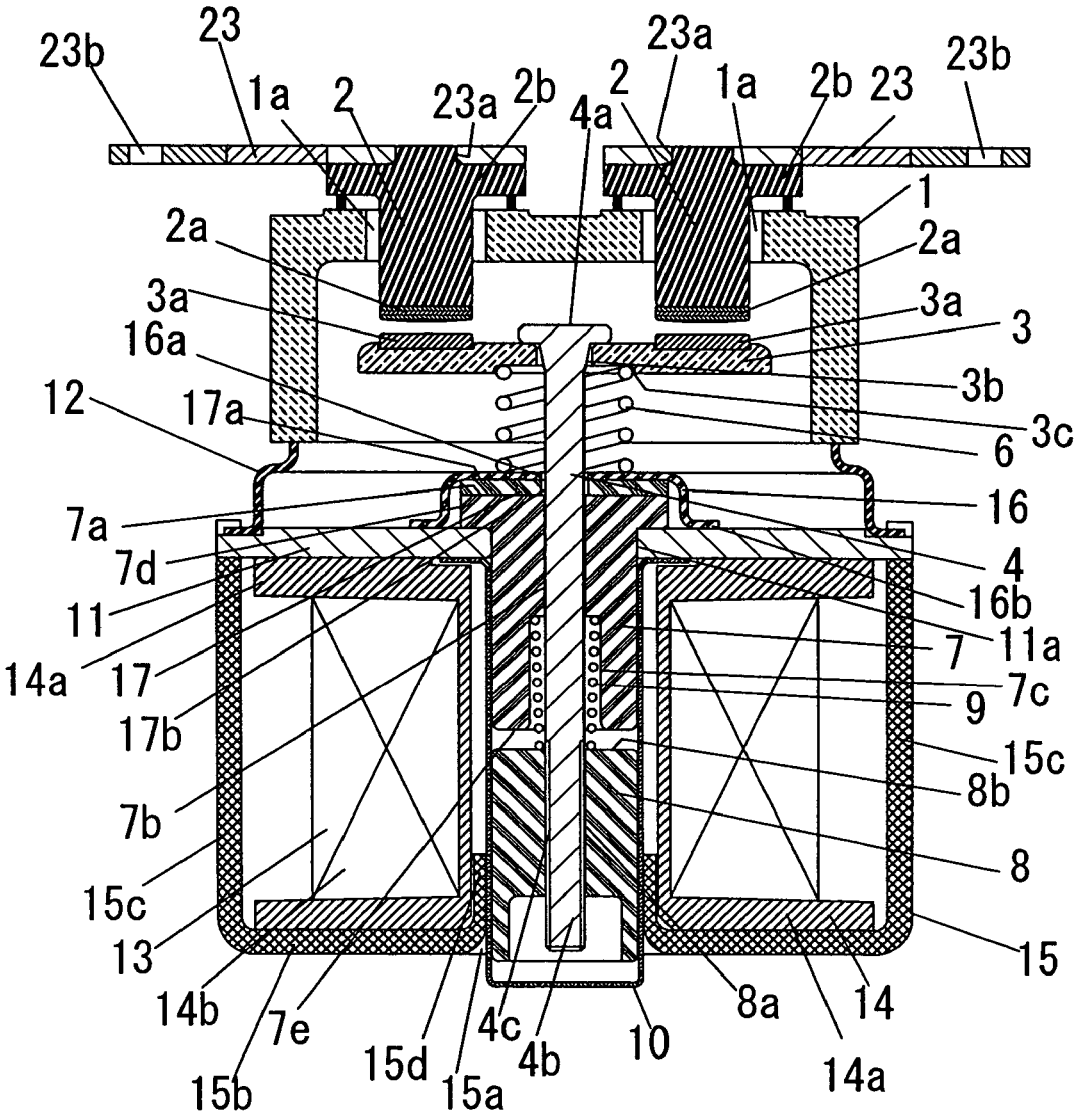
FIG. 14 is a sectional view of the contact device of FIG. 1 to which a conductive bar is connected.

By the way, in order to electrically connect the fixed terminal with an external electrical circuit, a conductive bar (an external connection terminal) 23 shown in FIG. 14 may be connected to the fixed terminal 2. The conductive bar 23 has, at its one end, a through hole 23*a* for connection to a head of the fixed terminal, and has, at the other end, a screw hole 23*b* for connection to the external electrical circuit.

As disclosed in Japanese Non-examined Patent Publication No.10-162676, a conventional conductive bar is formed into a plate shape from a copper material and so on. However, when the fixed terminal is connected to an external electric circuit by the conventional conductive bar, the vibration generated when the movable core 8 hit the movable core receiver 7 is propagated to the external electric circuit through the conductive bar, and the operating noise may be generated from the external electric circuit. In order to prevent such an operating noise, it is preferable to lower stiffness of the conductive bar so as to make it difficult for the conductive bar to propagate the vibration to the external electric circuit.

Figure 15:
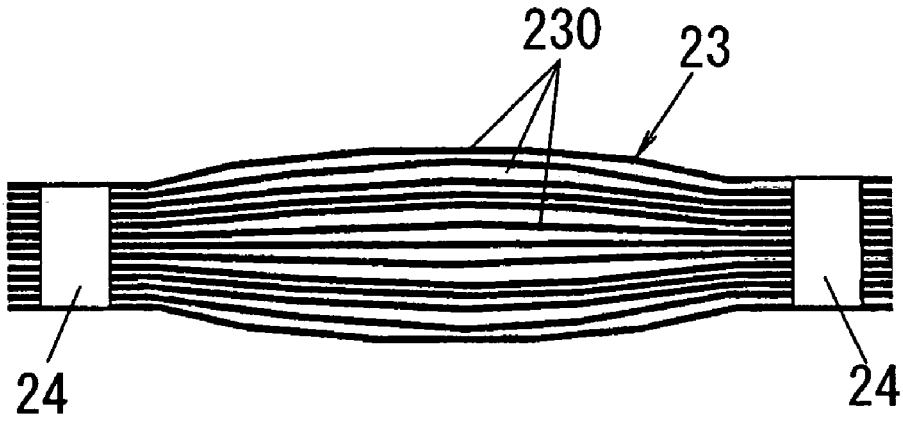
FIG. 15 is an enlarged view of the conductive bar of FIG. 14.

So, as shown in FIG. 15, the conductive bar 23 of the present invention is formed by stacking a plurality of thin plates 230 in the thickness direction. Each plate 230 is formed into a plate shape from a copper material, such as copper alloy (Cu—Fe series, Cu—Sn series, and Cu—Cr series), and has, at its one end, a through hole (not shown) for connection to the head of the fixed terminal, and has, at the other end, a screw hole (not shown) for connection to the external electrical circuit. The stiffness of the conductive 23 is inversely proportional to the cube of a length of the thin plate, and is proportional to the cube of a thickness of the thin plate, and is proportional to a width of the thin plate, and is inversely proportional to the number of thin plates. So, by forming the conductive bar 23 by stacking the thin plates 230, it is possible to lower the stiffness of the conductive bar 23. Or, composition of the center area of the conductive bar 23 and the both ends thereof may be changed so as to lower the stiffness of the center area than that of the both ends.

Figure 16:
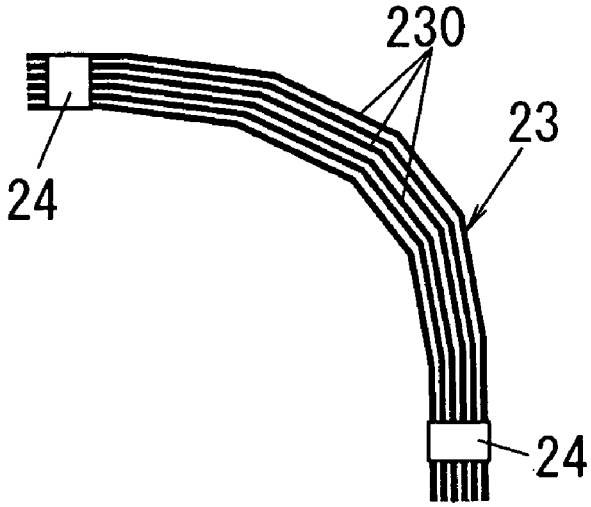
FIG. 16 is a view showing another constitution of the conductive bar of FIG. 14.

Preferably, the plurality of thin plates 230 are connected to each other at both ends by welding 24. In this case, the stiffness of the both ends of the conductive bar 23 can be increased, so that it is possible to connect the fixed terminal 2 and the external electrical circuit through the conductive bar 23 with stability. As shown in FIG. 16, when a plurality of thin plates 230 having different lengths are stacked, it is possible to form a conductive bar 23 having a curved structure.

By the way, in the contact device of this embodiment shown in FIG. 1, the cylindrical upstanding piece 15*d* rises from a periphery of the through hole 15*a* formed in the center piece 15*b* of the yoke 15, and the cap 10 in which the movable core 8 is housed is disposed inside the upstanding piece 15*d*. By this, facing area of the movable core 8 and the yoke 15 is increased and magnetic resistance is decreased, whereby magnetic efficiency of the electromagnetic mechanism is increased. However, because the upstanding piece 15*d* stands between a cylindrical part of the coil bobbin 14 and the cap 10, a wasted space S is generated between the coil bobbin 14 and the cap 10, whereby a space for winding a winding of the coil bobbin 14 is reduced and the magnetic efficiency may be lowered.

Figure 17:
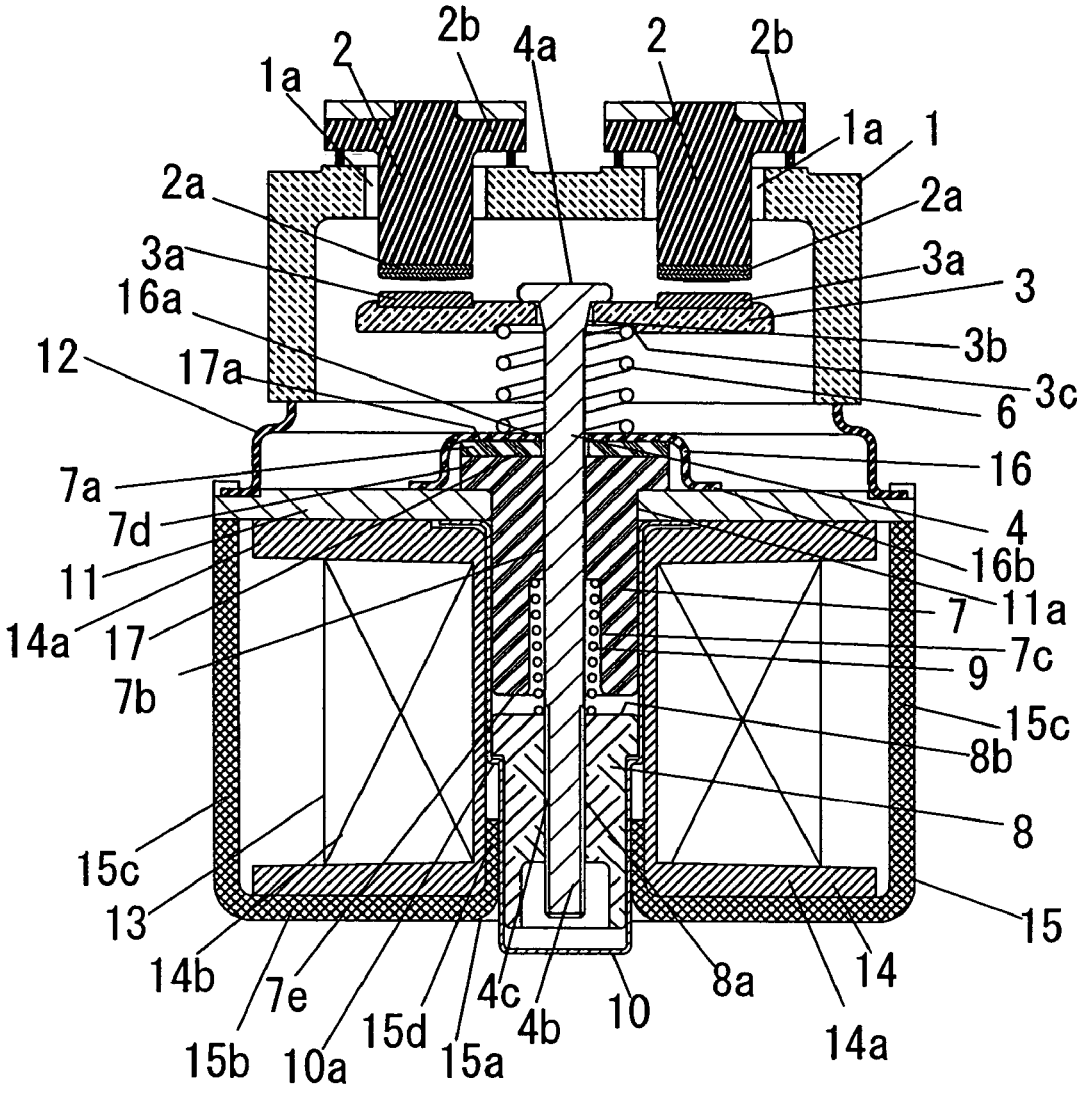
FIG. 17 is a sectional view showing another constitution of the contact device of FIG. 1.

So, as shown in FIG. 17, it is preferable that the movable core 8 is formed so that a diameter of a part thereof which faces the upstanding piece 15 (a lower part in FIG. 17) is smaller than that of a part thereof which does not face the upstanding piece 15*d* (an upper part in FIG. 17). As is the case with the movable core 8, the cap 10 is also formed so that a diameter of a part thereof which faces the upstanding piece 15 is smaller than that of a part thereof which does not face the upstanding piece 15*d*.

In this case, by disposing the upstanding piece 15*d* around the part of the movable core 8 having the small diameter, it is possible to eliminate the wasted space between the cylindrical part of the coil bobbin and the cap 10 and bring the cylindrical part of the coil bobbin 14 and the cap 10 into close contact with each other. As a result, the space for winding the winding is increased, whereby the magnetic efficiency can be increased. Furthermore, because the movable core is lightened by reducing the diameter of the movable core 8, the vibration generated when the movable core 8 hit the movable core receiver 7 is suppressed, whereby the operating noise generated when the movable core 8 hits the movable core receiver 7 can be reduced. Furthermore, because the movement speed of the movable core 8 is increased by the weight reduction, it is also possible to shorten the operating time of the contact device.

The movement of the movable core 8 of FIG. 17 in the downward direction of FIG. 17 is restricted by a step 10*a* of the cap 10 when the coil 13 is not energized. When the step 10*a* of the cap 10 restricts the movement of the movable core 8 as above, a touch area between the movable core 8 and the cap 10 at the time when power is off is reduced, as compared with a case where whole surface of the bottom of the cap 10 restricts the movement of the movable core 8 in the downward direction of FIG. 17, so that it is possible to reduce the operating noise generated when power is shut down.

Figure 18:
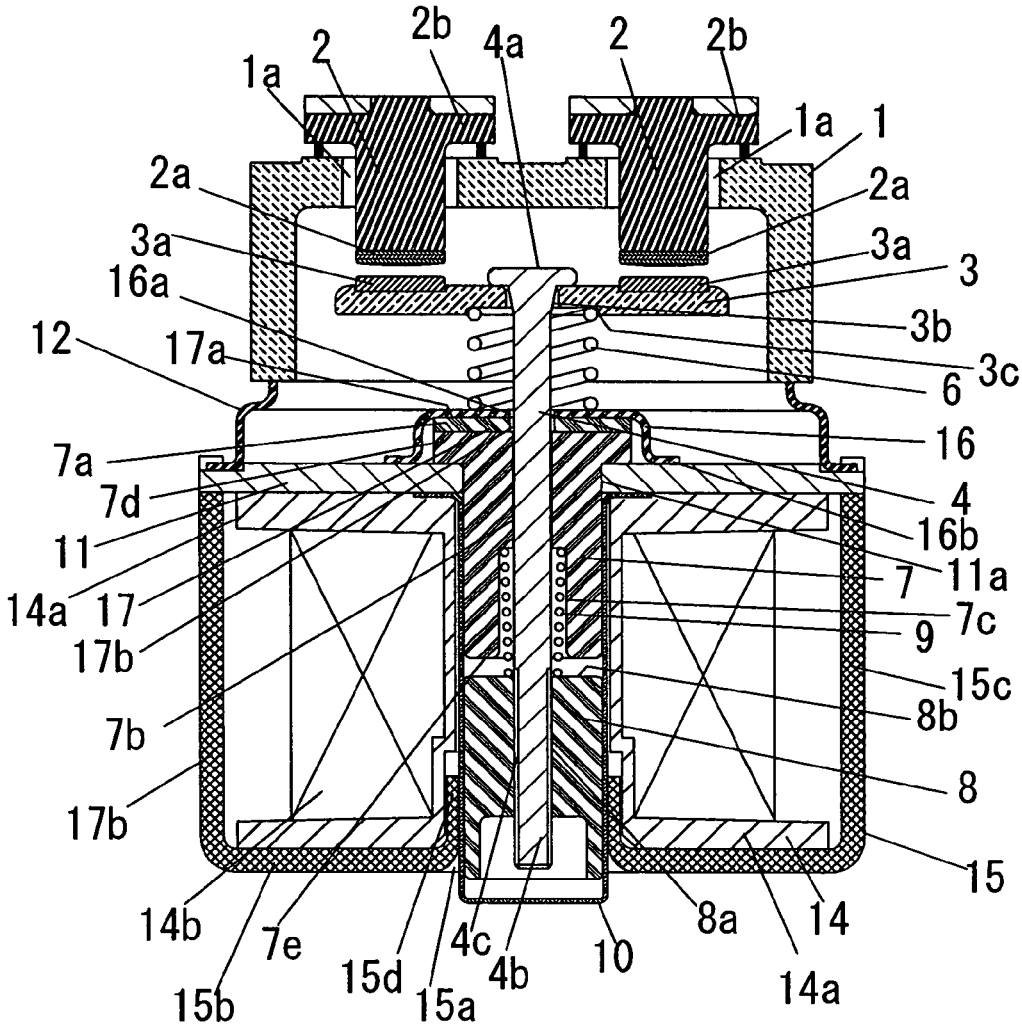
FIG. 18 is a sectional view showing another constitution of the contact device of FIG. 1.

As shown in FIG. 18, in order to eliminate the wasted space between the coil bobbin and the cap 10, a diameter of a part of the cylindrical part of the coil bobbin which does not face the upstanding piece 15*d* may be reduced. In this case, too, the space for winding the winding is increased, whereby the magnetic efficiency can be increased.

Figure 19A:
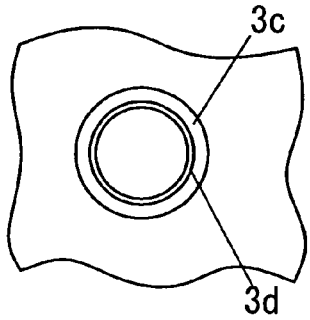
FIG. 19A is a plan view showing another constitution of a substantial part of the contact device of FIG. 1.
Figure 19B:
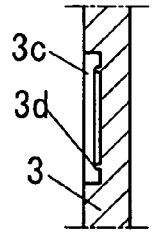
FIG. 19B is a sectional view of FIG. 19A.
Figure 19C:
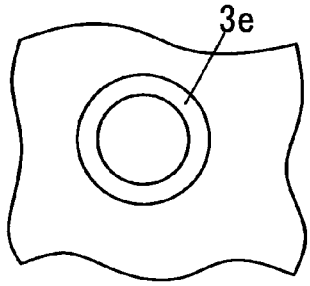
FIG. 19C is a plan view showing another constitution of the substantial part of the contact device of FIG. 1.
Figure 19D:
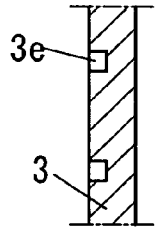
FIG. 19D is a sectional view of FIG. 19C.
Figure 19E:
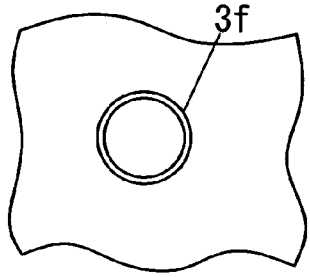
FIG. 19E is a plan view showing another constitution of the substantial part of the contact device of FIG. 1.
Figure 19F:
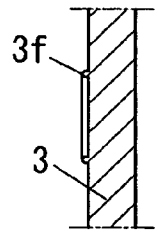
FIG. 19F is a sectional view of FIG. 19E.
Figure 19G:
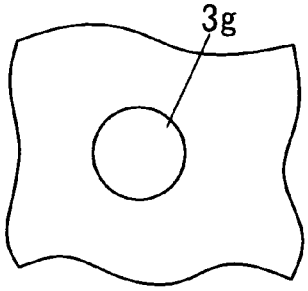
FIG. 19G is a plan view showing another constitution of the substantial part of the contact device of FIG. 1.
Figure 19H:
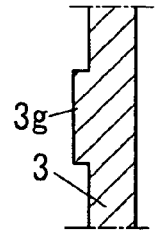
FIG. 19H is a sectional view of FIG. 19G.
Figure 19I:
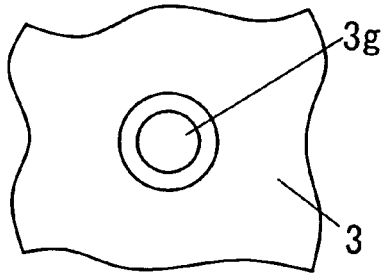
FIG. 19I is a plan view showing another constitution of the substantial part of the contact device of FIG. 1.
Figure 19J:
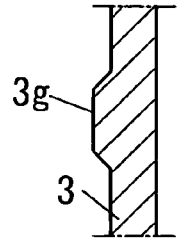
FIG. 19J is a sectional view of FIG. 19I.
Figure 19K:
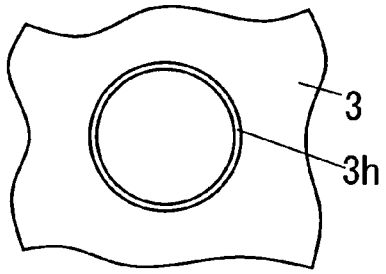
FIG. 19K is a plan view showing another constitution of the substantial part of the contact device of FIG. 1.
Figure 19L:
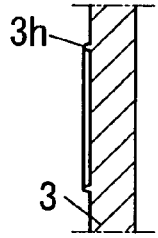
FIG. 19L is a sectional view of FIG. 19K.
Figure 19M:
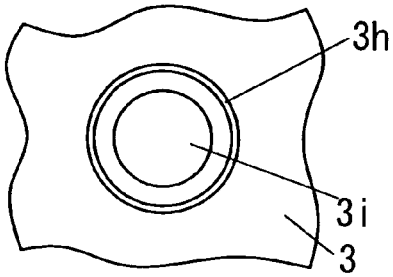
FIG. 19M is a plan view showing another constitution of the substantial part of the contact device of FIG. 1.
Figure 19N:
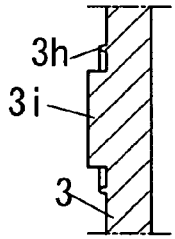
FIG. 19N is a sectional view of FIG. 19M.
Figure 19O:
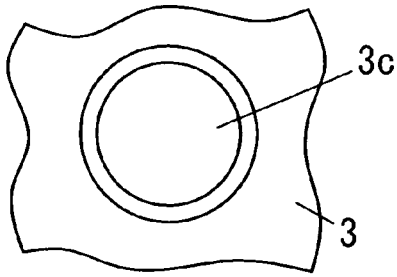
FIG. 19P is a sectional view of FIG. 19O.
FIG. 19Q is a plan view showing another constitution of the substantial part of the contact device of FIG. 1.
FIG. 19R is a sectional view of FIG. 19Q.
Figure 19P:
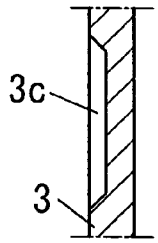
Figure 19Q:
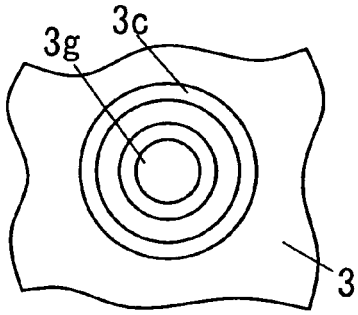
Figure 19R:
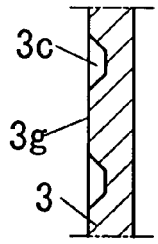

In this embodiment, as shown in FIG. 1, in order to secure the pressure spring 6 to the movable armature 3, a concave portion 3*c* is formed in the surface on the pressure spring 6 side of the movable armature 3 to secure the pressure spring 6. The concave portion 3*c* has a generally round shape having an inner diameter nearly equal to the external diameter of the pressure spring 6. By engaging the end of the pressure spring into the concave portion 3*c*, it is possible to restrict the sliding of the pressure spring 6. As a result, positional misalignment of the pressure spring 6 can be suppressed, whereby it is possible to obtain a stable operation. As shown in FIGS. 19A and 19B, a generally cylindrical convex portion 3*d* having an external diameter nearly equal to the inner diameter of the pressure spring 6 may be formed on the bottom of the concave portion 3*c*, and the pressure spring 6 may be engaged onto the circumference of the convex portion 3*d*. Or, as a substitute for the concave portion 3*c*, as shown in FIGS. 19C and 19D, a circular groove 3*e* having a diameter nearly equal to that of the pressure spring 6 may be formed, and the end of the pressure spring 6 may be inserted into the groove 3*e*. Or, as shown in FIGS. 19E to 19H, a cylindrical convex portion 3*f* or a columnar convex portion 3*g* having an external diameter nearly equal to the inner diameter of the pressure spring 6 may be formed, and the end of the pressure spring 6 may be engaged onto the circumference of the convex portion 3*f* or convex portion 3*g*. As shown in FIGS. 191 and 19J, an outer circumference surface of the convex portion 3*g* may be tapered. Or, as shown in FIGS. 19K and 19L, a cylindrical convex portion 3*h* having an inner diameter nearly equal to the outer diameter of the pressure spring 6 may be formed, and the end of the pressure spring 6 may be inserted into the convex portion 3*h*. Or, as shown in FIGS. 19M and 19N, a columnar convex portion 3*i* having an outer diameter nearly equal to the inner diameter of the pressure spring 6 may be formed inside the cylindrical convex portion 3*h*, and the end of the pressure spring 6 may be engaged onto the circumference of the convex portion 3*i*. Or, as shown in FIGS. 190 and 19P, the inner circumference surface of the above concave portion 3*c* may be tapered. Or, as shown in FIGS. 190 and 19R, the inner circumference surface and the outer circumference surface of the above groove 3*e* may be tapered.

Although, in this embodiment, a sealed contact device in which the fixed contacts and the movable contacts are housed in the sealed case is taken as an example of a contact device, the contact device of the present invention is not limited to a sealed contact device, and may be a contact device in which the fixed contact and the movable contact are not sealed.

Second Embodiment

Figure 20:
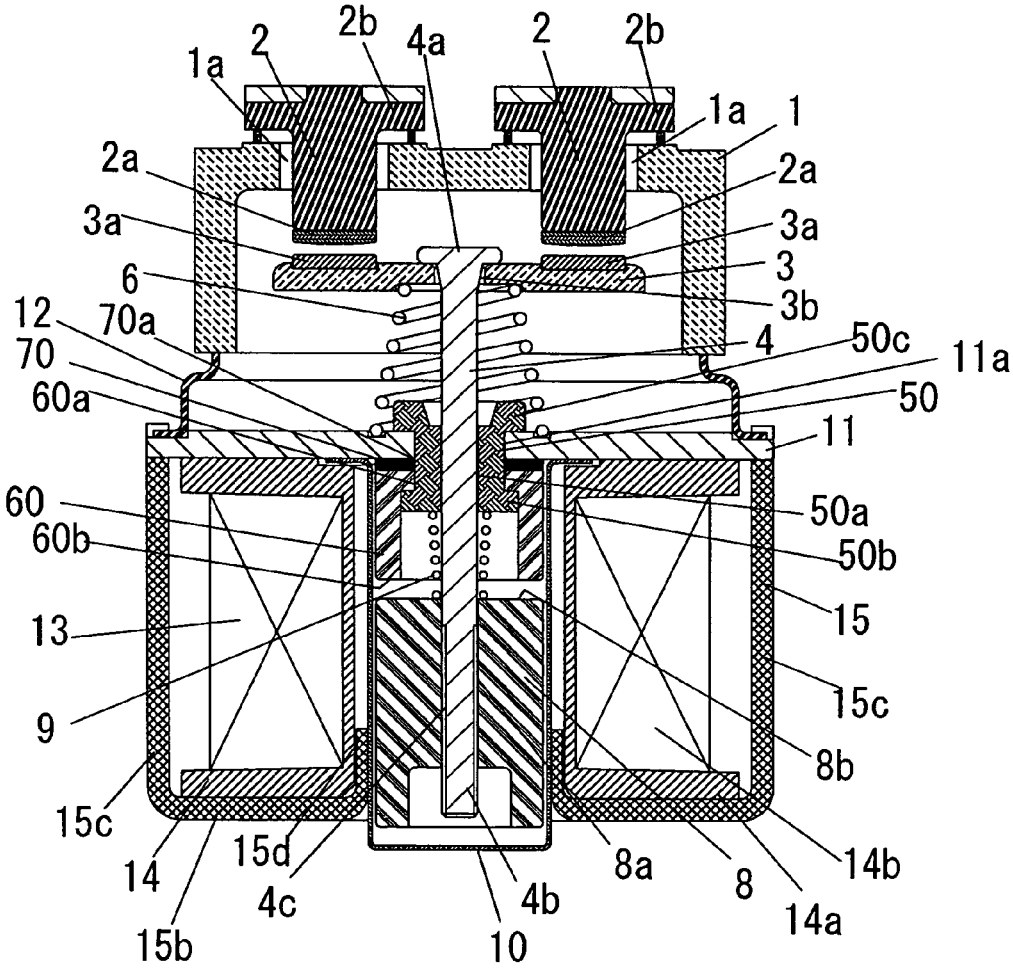
FIG. 20 is a sectional view of a contact device in accordance with a second embodiment of the present invention.
Figure 21:
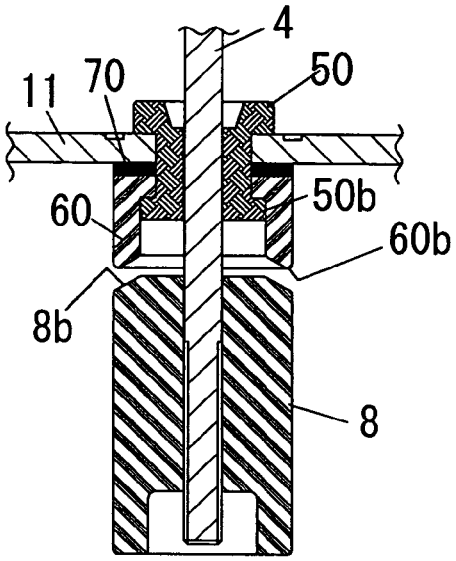
FIG. 21 is a sectional view showing another constitution of a substantial part of the contact device of FIG. 20.

FIG. 20 shows a contact device in accordance with a second embodiment of the present invention. The basic composition of this embodiment is identical to the first embodiment except the constitution of the sealed contact part, so similar parts to the first embodiment are identified by the same reference character and no duplicate explanation is made here.

The sealed contact part of this embodiment has a fixed core 50. The fixed core 50 has a through hole 50*a* into which the movable shaft 4 is inserted and a flange 50*b* at one end.

The movable core receiver 60 of this embodiment is formed into a cylindrical shape with a bottom from a magnetic material, and has, in the bottom, a hole 60*a* into which the fixed core 50 is inserted. The movable core receiver 60 is slid onto the circumference of the fixed core 50 so that a periphery of the hole thereof on the inner bottom side is engaged with the flange 50*b* of the fixed core.

The impact absorber 70 of this embodiment is formed into a disk shape from an elastic material such as silicon rubber, and has, at the center, a through hole 70*a* into which the fixed core 50 is inserted. The impact absorber 70 is slid onto the fixed core 50, and is disposed on the outer bottom of the movable core receiver 60.

The opposite end 50*c* of the fixed core 50 onto which the movable core receiver 60 and the impact absorber 70 were slid is inserted into the hole 11 a of the fixed plate 11 so that the flange 50*b* is located between the fixed plate 11 and the movable core 8, and the opposite end 50*c* protruding from the fixed plate 11 is caulked so that the fixed core 50 is secured to the fixed plate 11.

When the fixed core 50 is secured to the fixed plate 11, the movable core receiver 60, the impact absorber 70, and the fixed plate 11 are in contact with each other with no space therebetween, and the impact absorber 70 is restricted from moving by the fixed plate 11. That is, in this embodiment, a part of the fixed plate that is in contact with the impact absorber 70 constitutes the movement restriction member for restricting the movement of the impact absorber 70.

The contact device of this embodiment works as bellow.

When the coil 13 is energized, the movable core 8 is attracted to the movable core receiver 60 and moves thereto. As a result, the movable contacts 3*a* come in contact with the fixed contacts 2*a*. After that, the movable core 8 over-travels, and it comes in contact with the movable core receiver 60.

When the energization of the coil 13 is stopped, the movable armature 3 moves in the reverse direction by mainly the spring force of the return spring 9. As a result, the movable contacts 3*a* separate from the fixed contacts 2*a*, and the movable core 8 also separates from the movable core receiver 7, and the contact device returns to the initial state.

In the contact device constituted as above, because the impact absorber 70 is disposed between the movable core receiver 60 and the fixed plate 11 (the movement restriction member), the impact (vibration) generated when the movable core 8 hit the movable core receiver 60 is absorbed by the impact absorber 70. As a result, the contact device of the present invention can suppress the propagation of the vibration to the fixed plate 11 and the yoke 15 and so on, so that the contact device can reduce the operating noise. Furthermore, as is the case with the first embodiment, in this embodiment, because the impact absorber 70 is disposed on not the surface on the movable core side of the movable core receiver 60 but the surface on the movable armature side thereof, a magnetic gap is not generated between the movable core 8 and the movable core receiver 60 even when the impact absorber 70 is provided, whereby the attraction force is not reduced.

Although the surfaces 8*b* and 60*b* of the movable core 8 and the movable core receiver 60 which face each other are orthogonal to the moving direction of the movable core 8 in this embodiment, the surfaces 8*b* and 60*b* of the movable core 8 and the movable core receiver 60 which face each other may be inclined with respect to the moving direction of the movable core 8.

When the surface 8*b* and the surface 60*b* are inclined with respect to the moving direction of the movable core 8, as compared with the case where both surfaces 8*b* and 60*b* are orthogonal to the moving direction of the movable core 8, the gap between the surface 8*b* and the surface 60*b* becomes small, so that the magnetic attraction force between the movable core 8 and the movable core receiver 60 is increased. On the other hand, because total magnetic flux of each case is the same, in the case where the surface 8*b* and the surface 60*b* are inclined, when the movable core 8 comes close to the movable core receiver 60 and the gap between the surfaces 8*b* and 60*b* becomes smaller, the magnetic flux density is lowered by an increased facing areas, whereby the magnetic attraction force becomes smaller. Thus, the moving speed of the movable core 8 just before the movable core 8 hits the movable core receiver 60 is reduced, whereby the vibration generated when the movable core 8 hit the movable core receiver 60 can be suppress.

Figure 22:
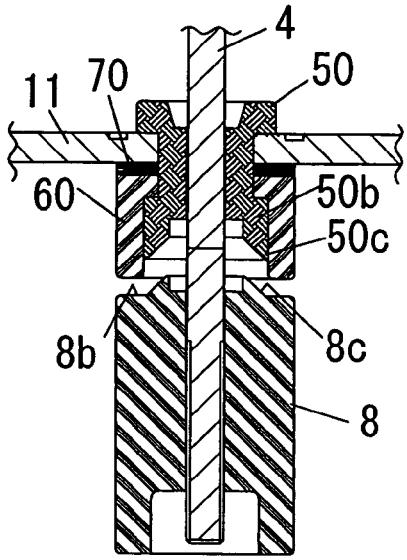
FIG. 22 is a sectional view showing another constitution of the substantial part of the contact device of FIG. 20.
Figure 23:
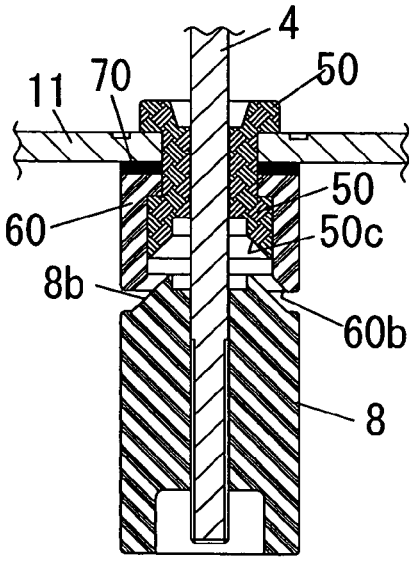
FIG. 23 is a sectional view showing another constitution of the substantial part of the contact device of FIG. 20.

In order to obtain the same effect, as shown in FIG. 22, the fixed core 50 may have an inclined surface 50*c* on a surface on the movable core side which inclines with respect to the moving direction of the movable core, and the movable core may have an inclined surface on a surface on the fixed core side thereof which faces the inclined surface 50*c* of the fixed core. Or, as shown in FIG. 23, the surface 60*b* of the movable core receiver 60 on the movable core side may incline with respect to the moving direction of the movable core and the fixed core 50 may have an inclined surface 50*c* of the movable core side, and the surface 8*b* of the movable core 8 on the fixed core side may inline with respect to the moving direction of the movable core so that it faces the surfaces 60*b* and 50*c*.

Figure 24:
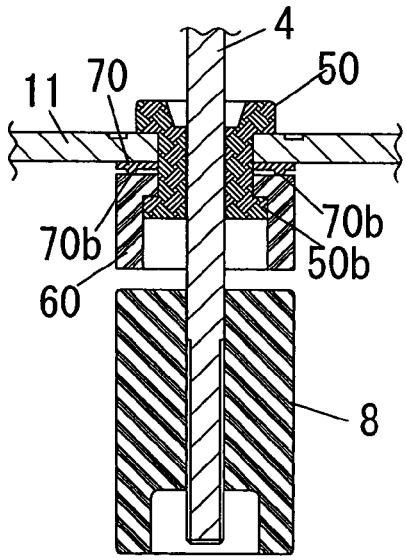
FIG. 24 is a sectional view showing another constitution of the substantial part of the contact device of FIG. 20.

In the contact device of this embodiment shown in FIG. 20, because the whole area of the impact absorber 70 is in contact with the movable core receiver 60, if a relative positional relation between the impact absorber 70 and the movable core receiver 60 becomes misaligned, the impact absorbing effect by the impact absorber 70 may be reduced. So, as shown in FIG. 24, it is preferable that the impact absorber 70 has a plurality of protrusions 70*b* on the surface facing the movable core receiver 60 and the tips of the protrusions 70*b* are in contact with the movable core receiver 60. In these cases, even when the relative positional relation between the impact absorber 70 and the movable core receiver 60 becomes misaligned, the impact absorbing effect by the impact absorber 70 is not reduced, and the operating noise can be reduced with stability.

Figure 25:
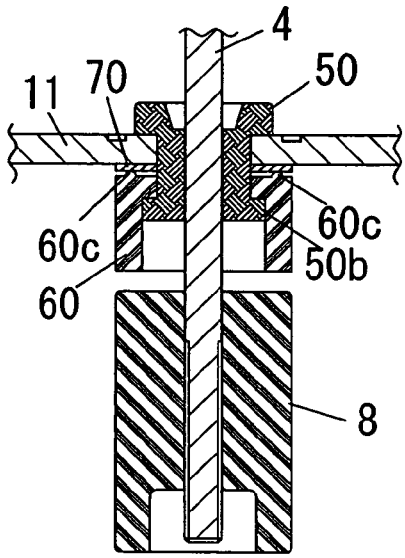
FIG. 25 is a sectional view showing another constitution of the substantial part of the contact device of FIG. 20.
Figure 26:
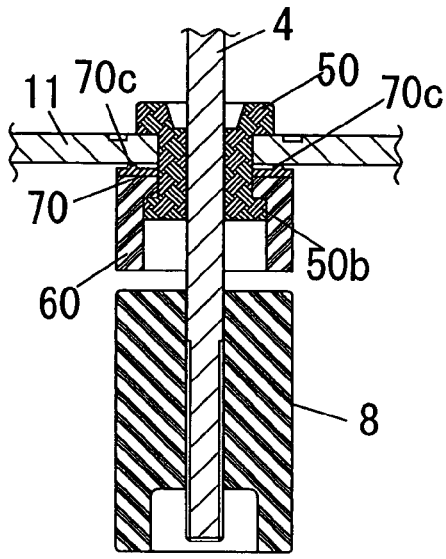
FIG. 26 is a sectional view showing another constitution of the substantial part of the contact device of FIG. 20.
Figure 27:
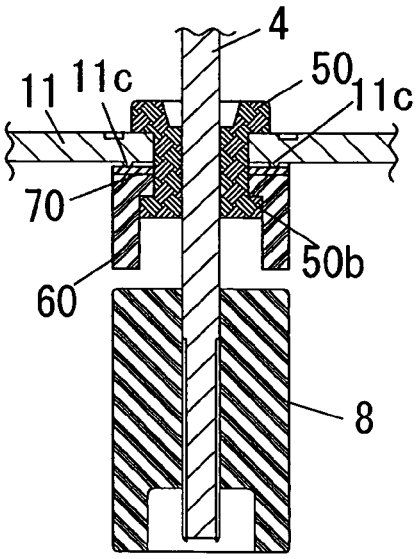
FIG. 27 is a sectional view showing another constitution of the substantial part of the contact device of FIG. 20.

In order to obtain the same effect, as shown in FIG. 25, the movable core receiver 60 may have a plurality of protrusions 60*c* on the surface facing the impact absorber 70 and the tips of the protrusions 60*c* may be in contact with the impact absorber 70. Or, as shown in FIG. 26, the impact absorber 70 may have a plurality of protrusions 70*c* on the surface facing the fixed plate 11 and the tips of the protrusions 70*c* may be in contact with the fixed plate 11. Or, as shown in FIG. 27, the fixed plate 11 may have a plurality of protrusions 11 c on the surface facing the impact absorber 70 and the tips of the protrusions 11 c may be in contact with the impact absorber 70.

By the way, when the coil 13 is energized, a magnetic path is formed between the inner bottom surface of the movable core receiver 60 and the flange 50*b* of the fixed core 50. So, the magnetic attraction force acts on the movable core receiver 60 in a direction away from the impact absorber 70 (in the downward direction in FIG. 20), and the impact absorbing effect by the impact absorber 70 may be reduced.

Figure 28:
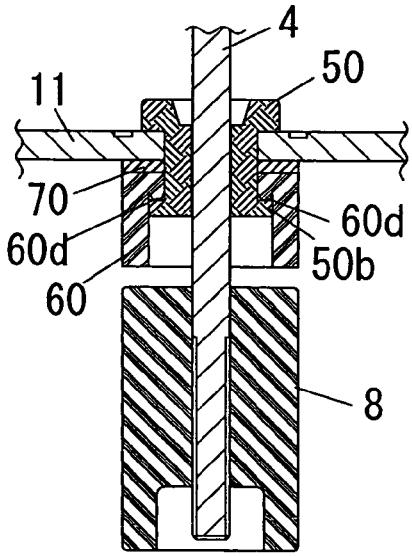
FIG. 28 is a sectional view showing another constitution of the substantial part of the contact device of FIG. 20.

So, preferably, as shown in FIG. 28, the movable core receiver 60 has a plurality of protrusions 60*d* on the inner bottom surface and the tips of the protrusions 60*d* are in contact with the flange 50*d* of the fixed core. In this case, the magnetic resistance between the movable core receiver 60 and the fixed core 50 is increased and the magnetic attraction force is reduced, so that the impact absorbing effect of the impact absorber 70 can be increased.

Figure 29:
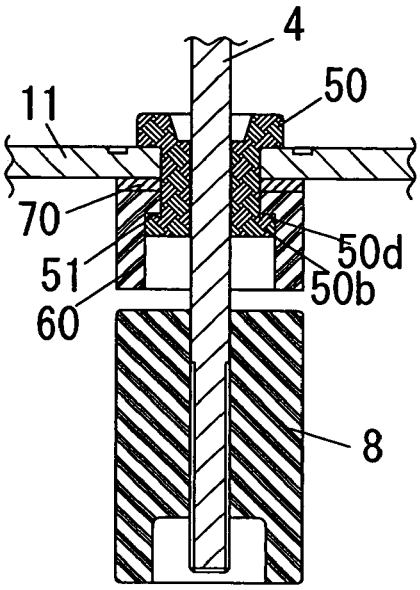
FIG. 29 is a sectional view showing another constitution of the substantial part of the contact device of FIG. 20.
Figure 30:
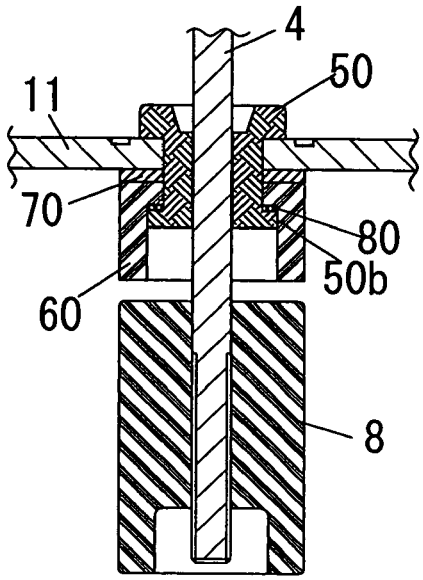
FIG. 30 is a sectional view showing another constitution of the substantial part of the contact device of FIG. 20.

In order to obtain the same effect, as shown in FIG. 29, the flange 50*b* of the fixed core may have a plurality of protrusions 50*d* on a surface facing the inner bottom surface 60*b* of the movable core receiver 60, and the tips of the protrusions may be in contact with the inner bottom surface of the movable core receiver 60. Or, as shown in FIG. 30, a residual plate 80 made of a nonmagnetic material may be disposed between the flange 50*b* of the fixed core and the inner bottom surface of the movable core receiver 60.

As mentioned above, as many apparently widely different embodiments of this invention may be made without departing from the spirit and scope thereof, it is to be understood that the invention is not limited to the specific embodiments thereof except as defined in the appended claims.

The invention claimed is:

1. A contact device comprising:

a fixed terminal with a fixed contact;

a movable armature with a movable contact which contacts to or separates from said fixed contact;

a movable shaft connected to said movable armature at its one end;

a movable core secured to an opposite end of said movable shaft;

an electromagnetic mechanism for driving said movable core in response to an excitation current so as to bring said movable contact into contact with said fixed contact;

wherein said contact device further comprises:

a movable core receiver slid onto said movable shaft so that it faces a surface of said movable core which faces the movable armature to receive said movable core driven by said electromagnetic mechanism, an impact absorber made of elastic material disposed on a surface on the movable armature side of said movable core receiver to absorb an impact generated when said movable core hit said movable core receiver, and a movement restriction member disposed on a surface on the movable armature side of said impact absorber to restrict a movement of said impact absorber, wherein the impact absorber is disposed between the movable core receiver and the movement restriction member.

2. The contact device as set forth in claim 1, wherein said electromagnetic mechanism includes a yoke which has a generally U-shaped configuration and houses said movable core and said movable core receiver therein, said contact device further comprising a fixed plate made of a magnetic material and connected to said yoke so that it closes tips of said yoke, said fixed plate having a hole into which said movable core receiver is inserted, said movable core receiver having a flange at an end on the movable armature side and being engaged with a surface on the movable armature side of said fixed plate by said flange in a condition where an end on the movable core side of said movable core receiver is inserted into said hole of said fixed plate, said movement restriction member having a cylindrical shape with a bottom and having a hole into which said movable shaft is inserted and being slid onto said movable shaft so that an inner bottom surface of said movement restriction member is in contact with the surface on the movable armature side of said impact absorber, a periphery of an opening of said movement restriction member being fixed on said fixed plate.

3. The contact device as set forth in claim 1, wherein said electromagnetic mechanism includes a yoke which has a generally U-shaped configuration and houses said movable core and said movable core receiver therein, said contact device further comprising a fixed plate made of a magnetic material and connected to said yoke so that it closes tips of said yoke and a fixed core, said fixed core having a through hole into which said movable shaft is inserted and a flange at one end in the axial direction, said fixed plate having a hole into which said fixed core is inserted, said fixed core being secured to said fixed plate so that said flange is disposed between said fixed plate and said movable core, said movable core receiver having a cylindrical shape with a bottom and having a hole in the bottom into which said fixed core is inserted, said movement restriction member being slid onto said movable shaft so that an opening thereof faces the movable core side and being engaged with said flange of said fixed core by a periphery of said hole on the inner bottom side, said impact absorber being disposed in a gap between an outer surface of said movable core receiver and said fixed plate, a part of said fixed plate which is in contact with said impact absorber constituting said movement restriction member.

4. The contact device as set forth in claim 1, wherein a surface of said movable core receiver and a surface of said movable core which face each other are inclined with respect to a moving direction of said movable core.

5. The contact device as set forth in claim 3, wherein said fixed core has, on a surface on the movable core side, an inclined surface which inclines with respect to a moving direction of said movable core, said movable core having, on a surface on the fixed core side thereof, an inclined surface which faces said inclined surface of said fixed core.

6. The contact device as set forth in claim 1, wherein said impact absorber has a protrusion on a surface facing said movable core receiver, a tip of said protrusion being in contact with said movable core receiver.

7. The contact device as set forth in claim 1, wherein said impact absorber has a protrusion on a surface facing said movement restriction member, a tip of said protrusion being in contact with said movement restriction member.

8. The contact device as set forth in claim 1, wherein said movement restriction member has a protrusion on a surface facing said impact absorber, a tip of said protrusion being in contact with said impact absorber.

9. The contact device as set forth in claim 1, wherein said movable core receiver has a protrusion on a surface facing said impact absorber, a tip of said protrusion being in contact with said impact absorber.

10. The contact device as set forth in claim 2, wherein said flange of the movable core receiver has a protrusion on a surface facing said fixed plate, a tip of said protrusion being in contact with said fixed plate.

11. The contact device as set forth in claim 2, wherein said fixed plate has a protrusion on a surface facing said flange of the movable core receiver, a tip of said protrusion being in contact with said flange of the movable core receiver.

12. The contact device as set forth in claim 3, wherein said movable core receiver has a protrusion on the inner bottom surface, a tip of said protrusion being in contact with said flange of the fixed core.

13. The contact device as set forth in claim 3, wherein said flange of the fixed core has a protrusion on a surface facing the inner bottom surface of said movable core receiver, a tip of said protrusion being in contact with the inner bottom surface of said movable core receiver.

14. The contact device as set forth in claim 2, wherein a residual plate made of a nonmagnetic material is disposed between said flange of said movable core receiver and said fixed plate.

15. The contact device as set forth in claim 2, wherein a residual ring made of a nonmagnetic material is disposed on an inner circumference surface of the hole of said fixed plate.

16. The contact device as set forth in claim 15, wherein a residual plate made of a nonmagnetic material is disposed between said flange of said movable core receiver and said fixed plate, said residual plate and said residual ring being formed integrally.

17. The contact device as set forth in claim 3, wherein a residual plate made of a nonmagnetic material is disposed between said flange of said fixed core receiver and said inner bottom surface of said movable core receiver.

18. The contact device as set forth in claim 1, wherein said fixed contact has a conductive bar for electrical connection between said fixed terminal and an external electrical circuit, said conductive bar being formed by stacking a plurality of thin plates in a thickness direction.

19. The contact device as set forth in claim 18, wherein both ends of said conductive bar are welded.

20. The contact device as set forth in claim 1, wherein said contact device further comprises a boxy case for surrounding said contact device, said case having a holding piece on an inner surface thereof for holding said electromagnetic mechanism, said electromagnetic mechanism being kept separated from the inner surface of said case except said holding piece.

21. The contact device as set forth in claim 20, wherein said electromagnetic mechanism has a generally U-shaped yoke, said contact device further comprising a fixed plate made of a magnetic material and secured to said yoke so that it closes tips of said yoke, said holding piece holding a curved part of said yoke and a junction part between said yoke and said fixed plate.

22. The contact device as set forth in claim 20, wherein said electromagnetic mechanism further comprises a coil bobbin which has flanges at its both ends and around which a winding is wound between said flanges, said holding piece holding said flanges of said coil bobbin.

23. The contact device as set forth in claim 1, wherein said electromagnetic mechanism further comprises a coil bobbin which has flanges at its both ends and around which a winding is wound between said flanges, and a yoke which has a generally U-shaped configuration and houses said movable core and said movable core receiver therein and has, in an underside, a through hole which is communicated with an inside of said coil bobbin, said yoke having an upstanding piece which rises from a periphery of said through hole toward the inside of said coil bobbin, said movable core and said movable core receiver being housed in said coil bobbin in an order of said movable core to said movable core receiver from a side near said upstanding piece, said movable core having a generally cylindrical shape, a diameter of a part of said movable core which faces said upstanding piece being smaller than that of a part of said movable core which does not face said upstanding piece.

* * * * *